US006664545B2

(12) United States Patent
Kimmel et al.

(10) Patent No.: US 6,664,545 B2
(45) Date of Patent: Dec. 16, 2003

(54) GATE FOR MODULATING BEAM OF CHARGED PARTICLES AND METHOD FOR MAKING SAME

(75) Inventors: Joel R. Kimmel, Palo Alto, CA (US); Friedrich Engelke, Villingen (DE); Richard N. Zare, Standford, CA (US)

(73) Assignee: The Board of Trustees of the Leland Stanford Junior University, Palo Alto, CA (US)

( * ) Notice: Subject to any disclaimer, the term of this patent is extended or adjusted under 35 U.S.C. 154(b) by 0 days.

(21) Appl. No.: 10/230,606

(22) Filed: Aug. 28, 2002

(65) Prior Publication Data

US 2003/0146392 A1 Aug. 7, 2003

Related U.S. Application Data

(60) Provisional application No. 60/315,970, filed on Aug. 29, 2001.

(51) Int. Cl.[7] ..... H01J 1/46

(52) U.S. Cl. ..... 250/396 R; 313/348; 313/369; 313/166; 313/237; 313/338; 313/278; 313/236; 313/411; 250/398; 250/385; 250/386; 250/387; 250/389; 29/25.14; 29/25.17

(58) Field of Search ..... 250/396 R, 398, 250/385, 386, 387, 389; 313/348, 349, 146, 237, 338, 278, 236, 411; 29/25.14, 25.17

(56) References Cited

U.S. PATENT DOCUMENTS 3,212,169 A 10/1965 Glaser et al.
4,080,546 A 3/1978 Steigerwald et al.
4,150,319 A 4/1979 Nowak et al.
4,325,001 A 4/1982 Heslin
4,437,034 A 3/1984 Lewandowski et al.
6,300,626 B1 10/2001 Brock et al.

OTHER PUBLICATIONS

LeCursi et al., "Fabrication of Chopper for Particle Beam Instrument", Pub. No: 2003/0048059 A1, published Mar. 13, 2003.*

International Search Report issued by the International Patent Office (WIPO) in the cooresponding International Application No.: PCT/US02/27591 issued on Dec. 3, 2002.

Fernandez et al., "Hadamard Transform Time–of–Flight Mass Spectrometry: A High–Speed Detector for Capillary–Format Separations," *Analytical Chemistry*, Apr. 1, 2002, vol. 74, No. 7, pp. 1611–1617.

* cited by examiner

*Primary Examiner*—John R. Lee
*Assistant Examiner*—Zia R. Hashmi
(74) *Attorney, Agent, or Firm*—Parsons Hsue & de Runtz LLP

(57) ABSTRACT

Bradbury-Nielson gates for the modulation of beams of charged particles, particularly ion beams in mass spectrometry, have been produced with an adjustable wire spacing down to 0.075 mm or a smaller spacing. The gates are robust, they can be fabricated in less than 3 hours, and the method of production is reproducible. In time-of-flight mass spectrometers, fine wire spacing leads to improvements in mass resolution and modulation rates. Gates that were produced using this new method have been installed in a Hadamard transform time-of-flight mass spectrometer in order to demonstrate their utility.

28 Claims, 6 Drawing Sheets

GATE FOR MODULATING BEAM OF CHARGED PARTICLES AND METHOD FOR MAKING SAME

CROSS-REFERENCE TO RELATED APPLICATION

This application is a continuation-in-part application of a provisional patent application entitled "Method for Producing Finely Spaced Bradbury-Nielson Gates," by Joel R. Kimmel, Friedrich Engelke and Richard N. Zare, Serial No. 60/315,970, filed Aug. 29, 2001, which application is incorporated herein by reference in its entirety.

BACKGROUND OF THE INVENTION

This invention relates in general to a system for modulation of beams of charged particles, and in particular to a gate used for such purpose and a process for making the gate.

For many experiments, it is necessary to deflect the trajectory of a beam of charged particles. One of the most convenient methods for accomplishing this task is to use an interleaved comb of wires, which is called a Bradbury-Nielson gate (BNG). A BNG consists of two electrically isolated sets of equally spaced wires that lie in the same plane and alternate in potential. When no potential is applied to the wires relative to the energy of the charged particles corresponding to an "on" state of the beam, the trajectory of the charged particle beam is undeflected by the gate, as illustrated in FIG. 1A. To deflect the beam from its original trajectory, bias potentials of equal magnitude and opposite polarity are applied to the two individual wire sets. Deflection produces two separate beams, each making an angle $\alpha$ with respect to the path of the undeflected beam as shown in FIG. 1B. In this manner, it is possible to modulate or gate ion beams in a controlled fashion.

Bradbury-Nielson gates were developed as electron filters decades ago As these gates had a much smaller effective field size than the commonly used deflection plates, Bradbury-Nielson gates have been used for modulating ion beams in time-of-flight mass spectrometry (TOF-MS). Since that time, many groups have reported similar use. A common application is mass-to-charge (m/z) selection in time-of-flight mass spectrometry (TOF-MS). Ions are allowed to drift before reaching the gate where short "on pulses" allow only ions of a selected mass-to-charge to pass. Tandem configurations, where the rising and falling edges of the ion packets are created by two different BNGs, have been described as a way to improve mass resolution for m/z selection. Use of BNGs is also common in ion mobility mass spectrometry, where the gates regulate the injection of ion packets into the drift tube.

An extremely demanding application for these gates is Hadamard transform time-of-flight mass spectrometry (HT-TOFMS). In HT-TOFMS, the ion beam is modulated with a pseudo-random sequence of "on" and "off" pulses by applying the corresponding modulation to a Bradbury-Nielson gate. After the pseudo-random sequence is applied, the ion packets created by the on/off modulation interpenetrate one another as they drift through the flight tube. The detected signal is a convolution of the mass spectra corresponding to these packets. Using knowledge of the applied pseudo-random sequence, this signal is deconvoluted to yield a single mass spectrum.

In order to improve mass resolution and modulation pulse profiles, much effort has been made to produce Bradbury-Nielson gates with minimal spacing between wires. A detailed description of the use of this device in time-of-flight mass spectrometry appeared in 1995 by Vlasak et al. See "An interleaved comb ion deflection gate for m/z selection in time-of-flight mass spectrometry," by P. R. Vlasak et al., Rev. Sci Instrum., 1996, 67, 68–72. In this work, a wire spacing of 1 mm was achieved by weaving a wire through holes on two separate frames and applying tension with a bracing screw between the two frames. A significant reduction of the wire spacing to 0.5 mm was reported in 1998 by Stoermer et al. who used the grooves on two nylon threads to control the wire spacing. This group used two sequential grids to minimize pulse widths. Still, they concluded that further reduction in wire spacing would improve m/z selectivity in TOF experiments.

The next advance in the reduction of the wire spacings was reported by Brock, Rodriguez, and Zare, who were able to construct Bradbury-Nielson gates for their HTM-TOF mass spectrometer with a wire spacing of 0.16 mm, working by hand under a microscope to set the wires in a frame made from a piece of printed circuit board (PCB) and aligned by means of two threaded rods fixed to opposite ends of the PCB. This procedure was extremely laborious, requiring several days to complete the assembly of a single gate. Furthermore, the frames were expensive and the quality of the fabricated grids was inconsistent. It is therefore desirable to provide improved BNG and other gates used for modulating a beam of charged particles, and an improved method for making these gates.

SUMMARY OF THE INVENTION

This invention is based on the observation that the above difficulties are alleviated by providing a body having a surface, a hole through the surface and grooves on the surface to serve as alignment vehicles for the wires during the winding process. The body has also at least a first and a second electrical contact, preferably on or near the body. An electrically conducting wire is wound under tension onto the grooves. As a result, a first set of portions of the wire in grooves that are not adjacent to one another is in contact with the first electrical contact, and a second set of portions of the wire is in at least some of the remaining grooves are in contact with the second electrical contact. The first set is attached to the first electrical contact, and the second set is attached to the second electrical contact so that the portions of the two sets pass over one side of the hole through the surface. The grooves and the surface of the body are such that the two sets of wires are substantially co-planar at the hole.

An improved gate for electrically modulating a beam of charged particles comprises a body having a surface and grooves on the surface, a hole in the body through the surface and at least a first and a second electrical contact on or near the body. A first set of electrically conducting wires located in grooves that are not adjacent to one another but are in electrical contact with the first electrical contact. The gate also comprises a second set of electrically conducting wires located in at least some of the remaining grooves on the surface and in electrical contact with the second electrical contact. The two sets of portions of wires pass over one side of the hole at the surface. The grooves and surface are such that the two sets of wires are substantially co-planar at the hole.

Grooves that are in sections and wire positioning guides other than grooves may also be used instead. By employing such guides on the same body, it would be much easier to make or fabricate such guides so that they provide co-planar alignment for the wire. Preferably, the sectional grooves and guides are on the same surface of the body.

The invention also provides a method comprising winding electrically conducting wire under tension about a body. The body has a surface and a plurality of wire-positioning features along the surface. The wires are wound so that the positioning features maintain a first set of portions of the wire interspersed with a second set of portions of the wire across the surface. The two sets are electrically isolated from each other, and the first set of portions of the wire are attached to a first electrical contact and the second set of portions of the wire to a second electrical contact. The positioning features will often comprise groves in the surface of the body, may be defined by discrete protrusions extending from the surface, or the like.

When the device formed by any one of the methods described above is used, a beam of charged particles transiting a hole through the surface of the body is modulated using electrical potentials applied to the first and second electrical contacts while the portions of the first and second sets of the wire span the hole and are substantially co-planar at the hole.

In another aspect, the invention provides a gating apparatus for electrically modulating a beam of charged particles, the apparatus comprises a body having a surface and a hole in the body through the surface. A first set of electrically conducting wires are in electrical contact with a first electrical contact. A second set of electrically conducting wires are interspersed with the first set with a spacing between adjacent wires of the two sets being about 1 mm or less, said second set being in electrical contact with a second electrical contact, the two sets being electrically isolated from each other, wherein the two sets of portions of wires span the hole along the surface such that the two sets of wires are substantially co-planar at the hole. Optionally, the wires spanning the hole are in tension.

Each of the above-described gate and gating apparatus is preferably also provided with a driver unit for applying electrical potentials to the first and second electrical contacts in order to modulate the beam of charged particles transiting a hole through the surface of the body.

BRIEF DESCRIPTION OF THE DRAWINGS

FIG. 1A is a schematic diagram of an array of wires at the same electrical potential to illustrate the action of a Bradbury-Nielson gate when the gate is on.

FIG. 3A shows a "H"-shaped printed circuit board with an aperture in the center bar of the board and two electrical contacts on its back side to illustrate one embodiment of the invention.

FIG. 3B is a perspective view of the board of FIG. 3A with the polymer block of FIG. 2A attached to its front surface to illustrate one embodiment of the invention.

FIG. 3C is a perspective view of the board and polymer block of FIG. 3B and one wire winding in one of the grooves to illustrate one embodiment of a process for making a Bradbury-Nielson gate.

FIG. 3D is a perspective view of the gate of FIG. 3C with two pieces of printed circuit boards attached to the top and bottom sides of the polymer block and wire windings through other grooves in the block useful for illustrating an embodiment of the invention.

FIG. 3E is a view of the back side of the device of FIG. 3D after extraneous portions of the wires have been cut to show a finished Bradbury-Nielson gate to illustrate one embodiment of the invention.

For simplicity in description, identical components are labeled by the same numerals.

DETAILED DESCRIPTION OF THE EMBODIMENTS

According to this invention, Bradbury-Nielson gates can be produced with wire spacing as small as 0.075 mm, which can be carried out in three hours and which is readily adjustable. Moreover, this method is easily automated. We use synthetic polymers with controlled groove spacing and profile. The grooves are produced using a machining process. Our greatly improved speed of assembly is achieved by using a hand-cranked weaving tool that feeds one continuous wire into the grooves. In one embodiment, the alternating (positive and negative) sets of wires are wound separately and attached to electrically isolated contacts on the frame using epoxy adhesive.

Figure 2A:
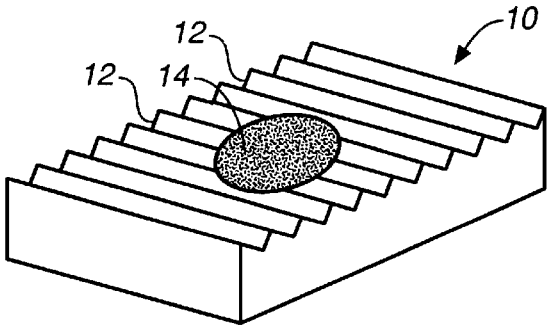
FIG. 2A is a perspective view of a block of polymer with grooves on one surface of the block and an aperture in the block through the surface to illustrate one embodiment of the invention.
Figure 2B:
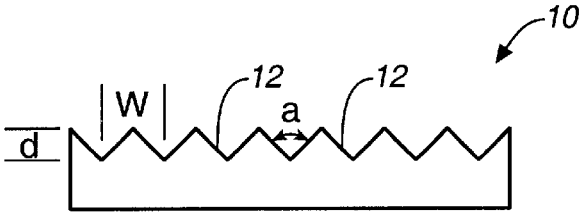
FIG. 2B is a cross-sectional view of a portion of block 10 of FIG. 2A that does not include the aperture.

In this embodiment, we machine grooves 12 with an interior angle of 90 degrees in the surface of a 38 mm×38 mm×7 mm block 10 of the polymer PEEK (poly ethyl ether ketone, Boedeker Plastics, Shiner, Tex.) or Ultem® 1000 (poly ether imide (PEI), Boedeker Plastics, Shiner, Tex.) as shown in FIGS. 2A and 2B. The space between adjacent grooves is selectable during the machining process, with a minimum value of 0.075 mm and a maximum error at any spacing of 0.005 mm. For a given spacing, groove depths are selectable and are preferably maximized. When grooves are spaced by 0.075 mm, a maximum depth may be 0.050 mm. Error in depth is estimated to be no more than 0.005 mm. A centered, 15-mm diameter aperture 14 (not shown in FIG. 2B) for passage of the ion beam is drilled in the polymer block 10, normal to the grooved surface. Preferably the block 10 has a planar surface before the machining process, and the grooves 12 are substantially identical, so that when a wire is wound into the grooves, the portions of the wire in the grooves are substantially coplanar.

Figure 2C:
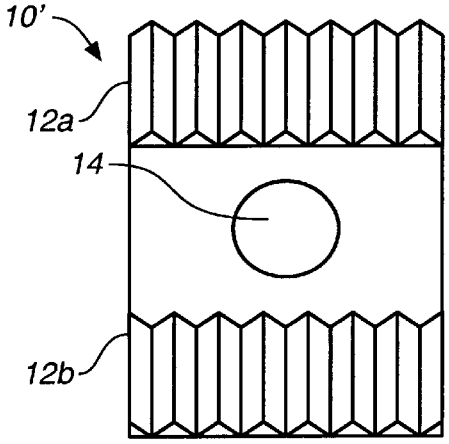
FIG. 2C is a perspective view of a block of polymer with grooves broken into two sections on one surface of the block and an aperture in the block through the surface to illustrate another embodiment of the invention.

While the above process is preferable, other configurations of the block 10 and grooves 12 are possible in order to achieve such coplanarity. Thus, for example, even where the surface of the block 10 is not planar, as long as the bottom portion of the grooves formed in the surface are shaped and positioned so that they are substantially coplanar, the portions of the wire wound into the bottom portions of the grooves will also be substantially coplanar. The grooves need not be in the shape of continuous elongated depressions on the surface of block 10 but can be in at least two sections 12*a* and 12*b* as shown in FIG. 2C; obviously the grooves can be in more than two sections. Such and other variations are within the scope of the invention. Since these sections are on the same surface of the block, which surface is preferably planar, the sectional grooves would also serve to align the wire during the winding process so that the two sets of wire portions are substantially co-planar. Wire guiding features other than grooves may also be used and are within the scope of the invention. For example, it is possible to illuminate light spots on the mandril or bar 20*a* and wind the wires using the light spots as a guide.

In an alternative embodiment, instead of machining a polymer block, the grooves may be formed by stamping a heated sheet of polyvinyl chloride with a machined metal stamp possessing the reverse image of the grooved pattern.

Figure 1A:
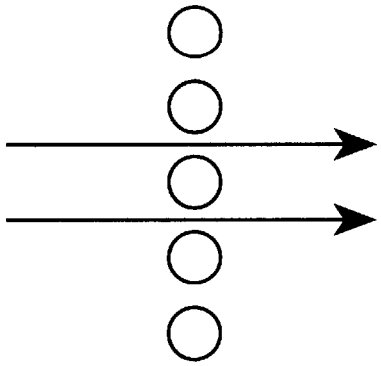
Figure 1B:
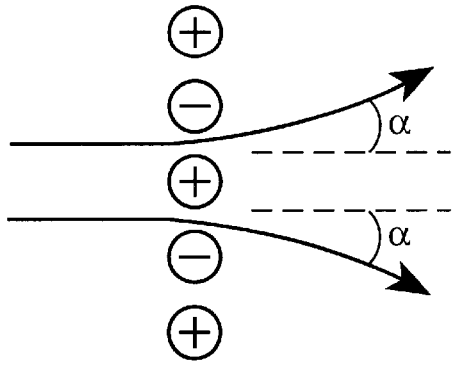
FIG. 1B is a schematic view of the array of wires of FIG. 1A, but where the wires are at different electrical potentials to illustrate the action of the Bradbury-Nielson gate when the gate is off.
Figure 3A:
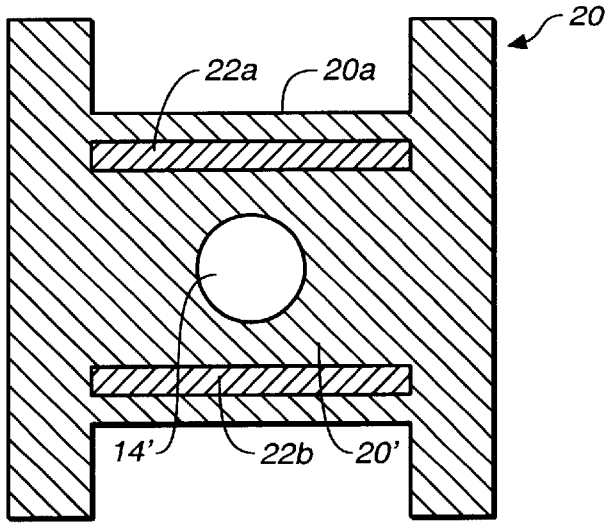
FIGS. 3A–3E are perspective views illustrating a process for making a Bradbury-Nielson gate to illustrate one embodiment of the invention.
Figure 3B:
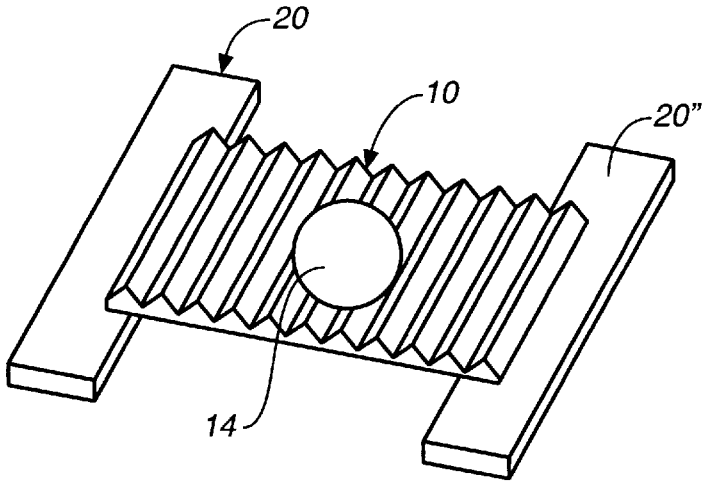

FIGS. 3A–3E illustrate the stages of Bradbury-Nielson gate assembly of one embodiment. The machined polymer 10 of FIG. 1A is mounted on the insulated front face 20" of an H-shaped portion 20 of single-sided copper-clad circuit board (outer dimensions are 60 mm×60 mm and the interior cross bar 20*a* has length 40 mm and width 30 mm (FIG. 3A) with the grooves running from the top to the bottom of the H (FIG. 3B). Two polymer-copper clad contacts 22*a* and 22*b* are fixed using epoxy (ITW Devcon Corp. Danvers, Mass.) on the back side 20' (block 10 being on the front side 20" of portion 20) of circuit board portion 20. Bar 20*a* defines therein an aperture 14' that matches aperture 14 of block 10.

Two small portions of single-sided copper clad 22*a* and 22*b* (30 mm×4 mm) are fixed on the bottom side 20' of the polymer (opposite the grooves) in the region where the block extends over the center bar 20*a* of the H-shaped copper frame. These pieces 22*a* and 22*b* serve as the electrical contacts for wire set 1 as described below.

The assembled piece in FIG. 3B is mounted on a hand-cranked (26) rotating screw 28 within a weaving instrument 40. A schematic of this device 40 is presented in FIG. 4. A 20 $\mu$m diameter gold-plated tungsten wire 30 (California Fine Wire Co., Grover Beach, Calif.) runs from its spool 32 over a directing screw 34, which is coupled to the band-cranked screw by a timing belt 36. Screw 28 is attached to the copper frame 20. The end of the wire is fixed to either of the mounted contacts 22*a* or 22*b* using epoxy or solder. To avoid having to redo the entire winding and fixing process should the wire be positioned wrong onto the block 10, it may be desirable to fix the wire to the contact(s) after every few windings by epoxy or solder. A 40 g weight 38 is hung from the wire, between the directing screw and the spool, to provide a constant tension on the wire. Beginning on one side of the center hole 14, the hand crank 26 is turned, rotating the frame 20 and drawing thread from the spool at approximately 2 cm/second.

Figure 3C:
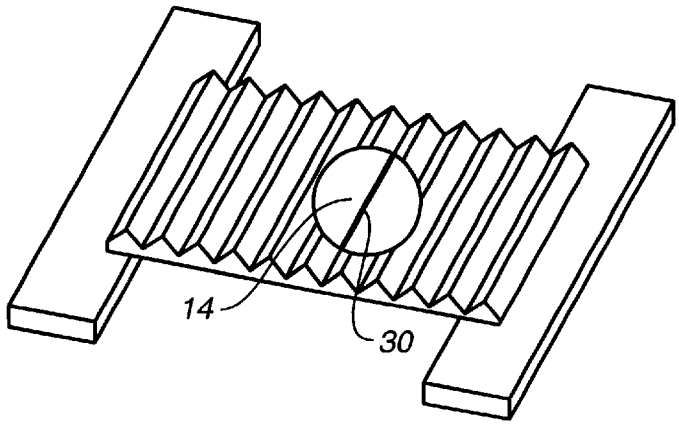

While watching through a microscope, wire set 1 is guided into alternating grooves (or grooves that are not adjacent to one another) on the surface of the polymer block 10 and around the bar 20*a* of frame 20 (FIG. 3C), touching both contacts 22*a* and 22*b* on each pass. As the hand crank 26 is turned, the threads of the directing screw 34 guide the wire 30 from one side of the frame to the other, across the width of the aperture 14. Wire position and frame position are adjusted to optimize wire/groove alignment during or after the winding. After winding the wire 30 across the entire width of the opening 14 (only one winding is shown in FIG. 3C for simplicity), the wire is bound to both copper contacts 22*a* and 22*b* using epoxy or solder. Once secure, a razor blade (not shown) is used to remove the segment of the wire between the two contacts 22*a* and 22*b* on the back side 20' of the frame 20 opposite the polymer block 10, leaving only portions of the wire in wire set 1 in the grooves between the contacts.

Figure 3D:
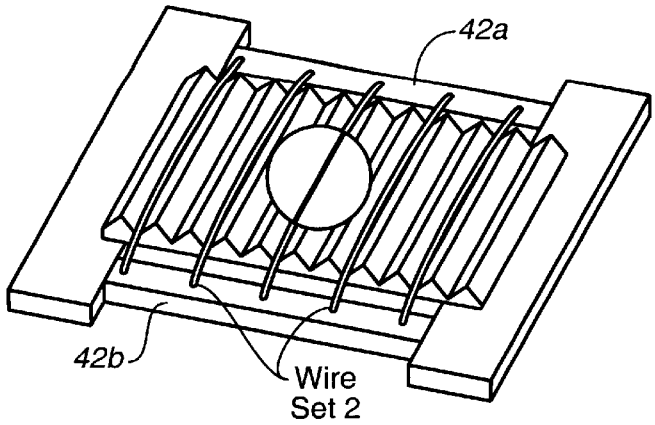
Figure 3E:
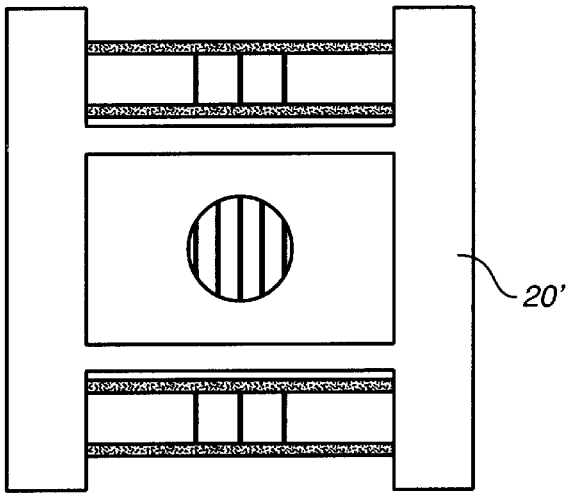

Two pieces 42*a* and 42*b* of a circuit board are glued directly to the top and bottom faces of the polymer block 10 at the ends of the grooves (FIG. 3D). The copper sides of the pieces 42*a* and 42*b* face out and the electrically insulated sides of the board pieces 42*a* and 42*b* cover segments of wire set 1. These pieces serve as the electrical contacts for wire set 2. Using the same procedure as used for wire set 1, wire set 2 is wound through the grooves between the wires of set 1 (or through at least some of such grooves) as shown in FIG. 3D. Again, the wires are cut, leaving wire only in the grooves and on the polymer side of the frame, after the wire is fixed (using epoxy or solder, for example) to the copper sides of the pieces 42*a* and 42*b*. FIG. 3E shows a view of the frame looking from the copper or back side of the frame 20. The dimensions of the described BNG frame and aperture match the specific requirements of a HT-TOFMS. The proposed method can be used for other customized geometries by modifying the dimensions of the components, and for other types of gates than the BNG.

Figure 6:
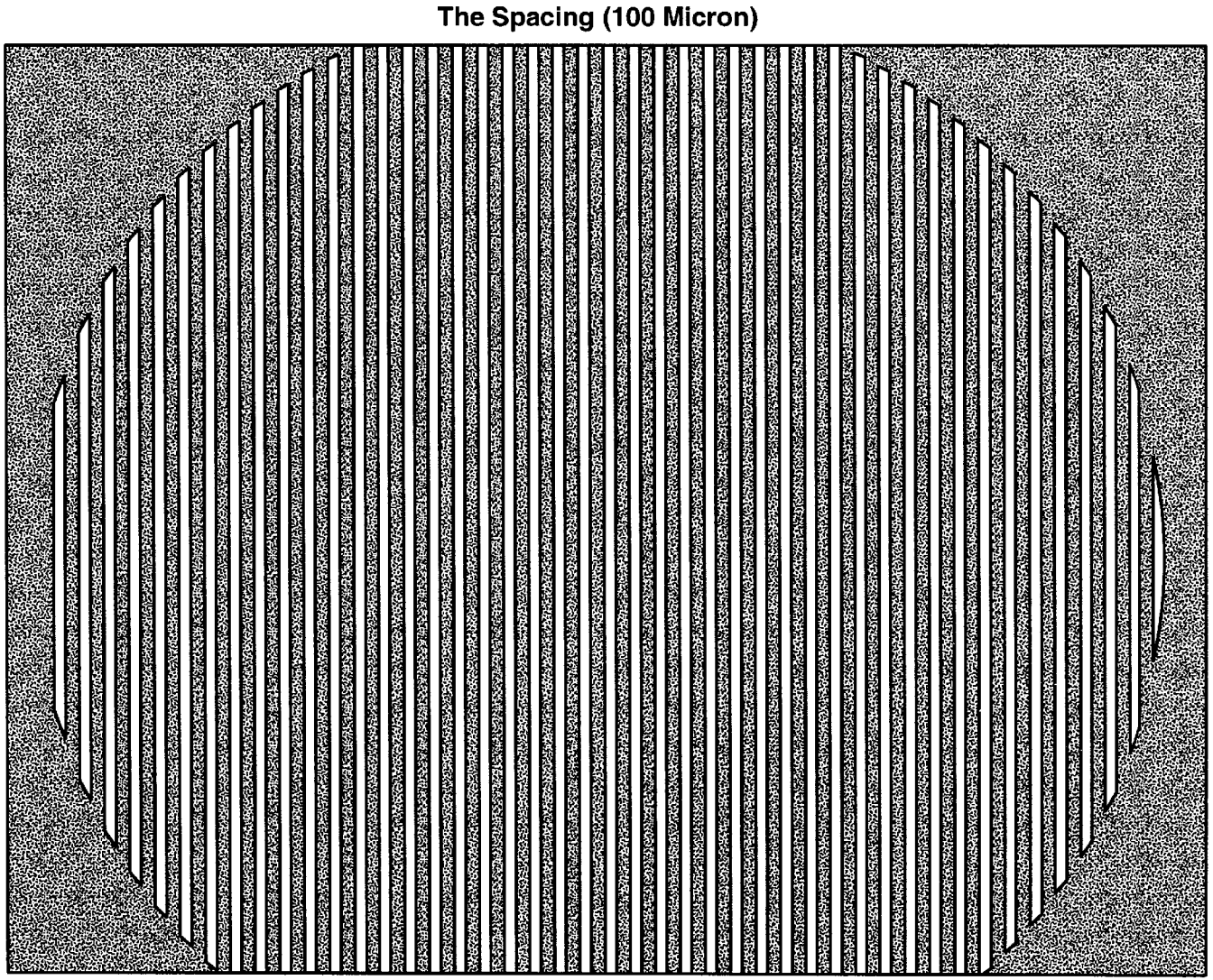
FIG. 6 is a view of a portion of the Bradbury-Nielson gate to illustrate one embodiment of the invention.
Figure 7A:
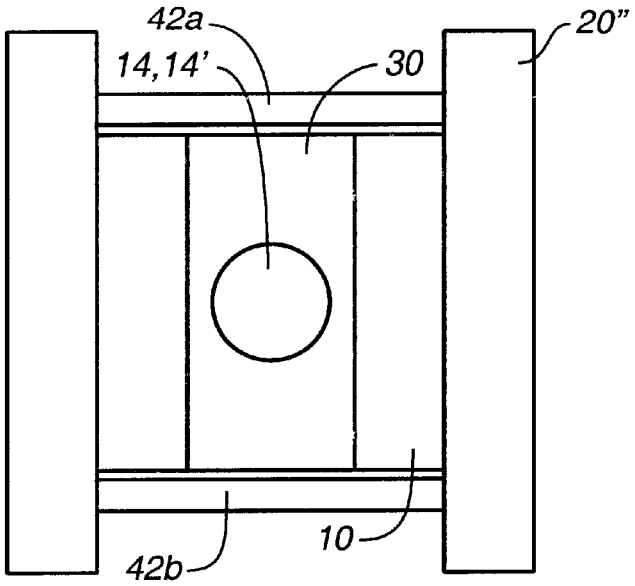
FIGS. 7A and 7B are views of the front and back of a Bradbury-Nielson gate to illustrate one embodiment of the invention.
Figure 7B:
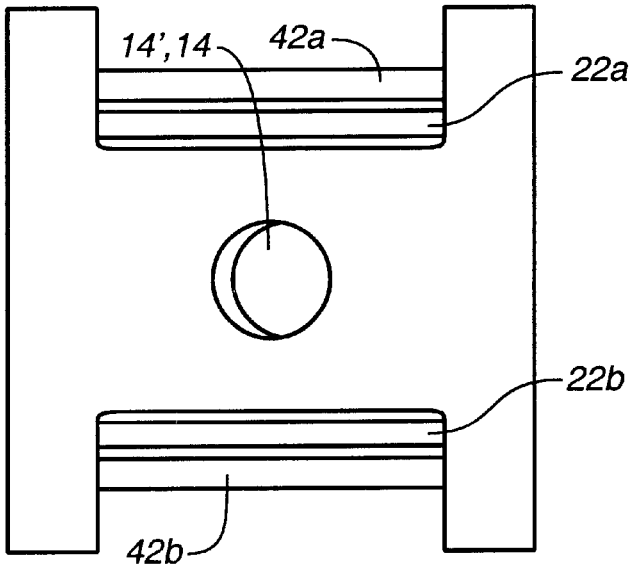

Using this technique we have fabricated Bradbury-Nielson gates with 0.150 mm, 0.100 mm, and 0.075 mm between adjacent wires. Thus spacings between adjacent wires of less than 0.100 mm are possible and are within the scope of the invention. The method works equally well at each of these scales. Ion gates with 0.300, 0.150, 0.100 and 0.075 mm wire spacing wound on an Ultem® 1000 frame have been installed in a HT-TOF mass spectrometer. FIG. 6 is a schematic view of a portion of the finished gate, showing the wire portions next to aperture 14, with 100 mm between adjacent wires. FIGS. 7A and 7B are views of the front and back of a Bradbury-Nielson gate made in the manner described above to illustrate one embodiment of the invention.

Experiments were conducted in the HT-TOFMS to demonstrate the deflection efficiency of the new BNG. In these experiments, ions were accelerated with −1250 V. With no modulation applied, wire sets 1 and 2 were held bias at voltages of −1285 and −1215 V respectively, leading to constant deflection of the ion beam. To modulate between deflected and undeflected modes, pulses with magnitudes of 35V and −35 V were simultaneously applied to wire sets 1 and 2, respectively. These pulses brought both sets of wires to the liner voltage (−1250 V). The beam is deflected off the axis of its initial trajectory when the wires are at their bias voltages (−1285 and −1215V), and the beam passes undeflected when both are at the liner voltage, −1250V. Modulation rates are on the order of 10 or more MHz, optionally being 20 MHz or more may be achieved, typically with rise times of about 10 ns and modulation voltages of 10 to 50 V with respect to the voltage of the ions, called the liner voltage (~1 kV).

The integrity of the HT-TOFMS deconvolution is dependent on the profile of the applied pulses and the discreteness of the sequence felt by the ions. Ions that are improperly modulated because of spatial and energetic ambiguities at the gate will be observed as noise after deconvolution of the detector signal. Such ambiguities can result if: (1) ions travel too slowly or the effective modulation region is too long and consequently ions are affected by multiple on/off pulses; and (2) rise times and noise destroy the square shape of a pulse, corrupting the binary nature of the modulation. As in any experiment using Bradbury-Nielson gates to shutter ions, the resolution of a HT-TOFMS is dependent on the modulation speed. On and off pulses applied to the gate have finite durations. At best, mass spectrometers can only resolve ions having flight times differing by times greater than the duration of these pulses. Likewise, when using an ion gate for m/z selection, the mass resolution of the gate is dependent on how rapidly the gate can switch the beam on and off. The mass resolution of a Bradbury-Nielson gate is thus dependent on how fast the necessary voltage can be applied to the wires and on the effective area of the electric field producing the modulation.

The first determinant of modulation rates is the electronics used. The circuitry used in HT-TOFMS allows application of on/off sequences with element widths between 40 and 200 ns. In order to produce square pulses, rise times are preferably small compared to these bin widths. The rise time of a pulse, arising from capacitive effects, is proportional to its voltage. It can be shown that as wire spacing is reduced, smaller voltages are adequate to achieve a given deflection angle. Thus, reductions in wire spacing allow faster modulation speeds.

Ideally the width of the modulation field in the direction parallel to the flight path would equal the diameter of the wires composing the gate. In this case, the fate of an ion would be determined as it crossed the plane of the gate. Simulations by other investigators predict that the effective field produced by a Bradbury-Nielson gate actually extends out along the normal to the plane of the gate a distance on the order of 0.80d, where d is the spacing between adjacent wires. Finer spacing between adjacent wires allows better time resolution when gating or modulating the ion beam because of the corresponding decrease in the longitudinal extension of the deflection field perpendicular to the plane of the gate. Given that in TOF experiments the flight time is proportional to the square root of an ion's mass-to-charge ratio, this temporal resolution translates to the mass resolution of a TOF mass spectrometer. In the special case of HT-TOFMS, the validity of the deconvolution also depends on the temporal accuracy of the modulation. Discrepancies between the intended sequence and applied sequence lead to artifacts referred to as masking errors.

Figure 5A:
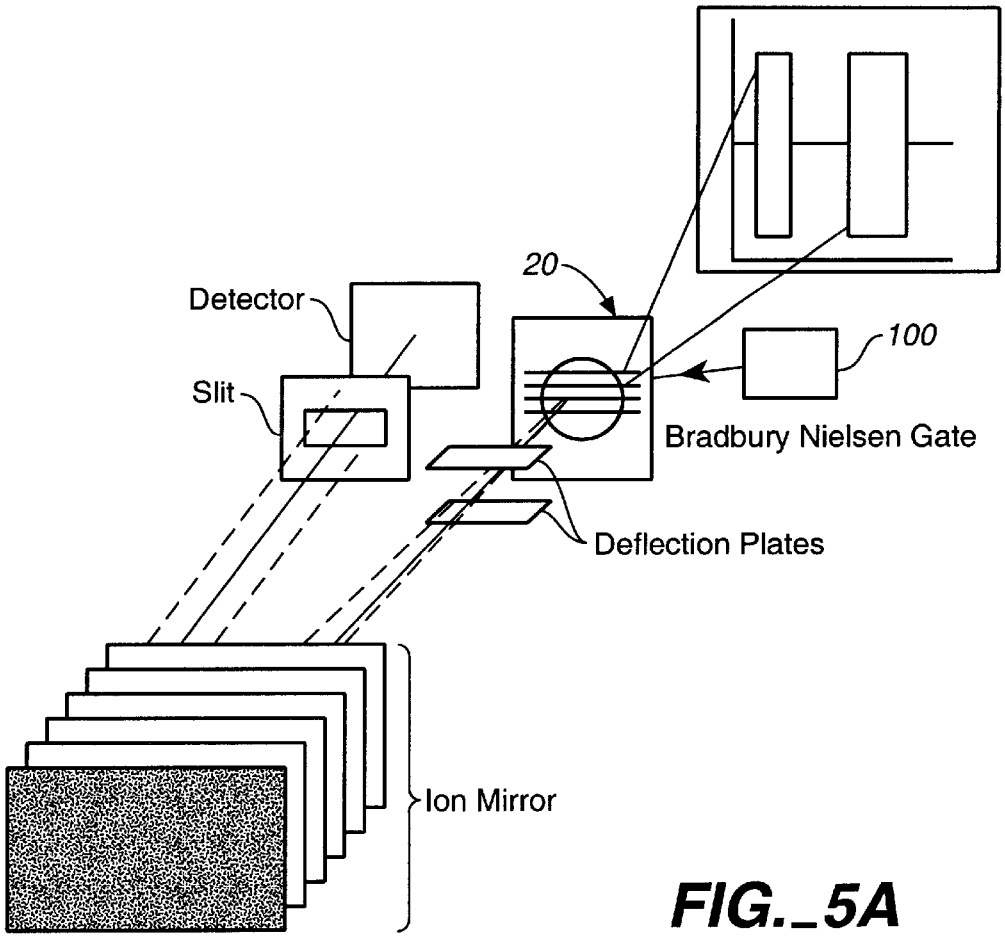
FIG. 5A is a perspective view of a Hadamard transform time-of-flight mass spectrometer employing one embodiment of the Bradbury-Nielson gate described in the application useful for illustrating the invention.
Figure 5B:
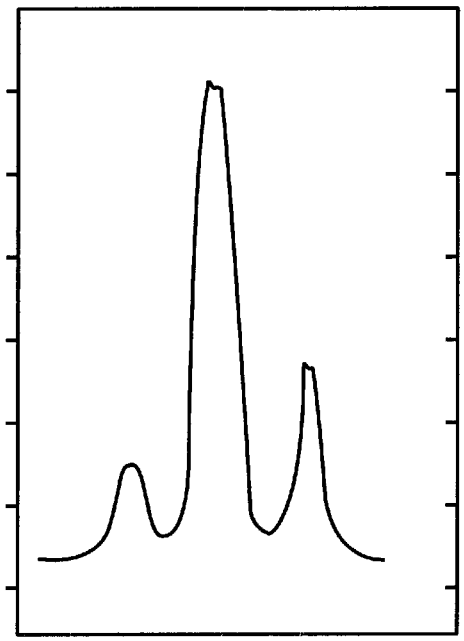
FIG. 5B is a graphical plot of a spectrum acquired by scanning the modes of a modulated beam across the slit using the apparatus of FIG. 5A.

FIG. 5A shows a schematic of the experiment. At standard operational deflection plate voltages, the undeflected beam (solid line) passes through the mask and hits the detector, while the deflected beams (dashed lines) are blocked. By varying the voltage in the deflection plates while applying the modulation, the three beams were each steered across the mask opening. Modulation of the beam by means of the Bradbury Nielsen gate 20 is by means of a driver 100. The result is shown in FIG. 5B. Complete resolution of the "beam on" (center peak) and "beam off" (side peaks) modes was achieved with the new BNG. The voltage of the deflection plates was adjusted manually, leading to the slight lack of symmetry in the profile.

The 0.150 mm gate used for these experiments has been used for several months without any complications or degradation of the materials. Liner voltages between 1050 V and 1750 V and modulation voltages between 5 and 50 V have been applied with no detectable aging of the modulator.

With wire spacings as small as 0.075 mm, immediate improvements are expected in mass resolution for TOF measurements and temporal resolution for beam encoding. This decrease in wire spacing will also make possible the use of lower modulation voltages, leading to improvements in rise times of modulation pulses.

In the embodiment described above, wire set 1 and wire set 2 are wound separately, with wire set 1 being wound first around the center bar portion 20*a* and block 20, followed by the winding of wire set 2. It will be understood, however, that this is not required and that it is possible to wind the wire through each groove so that such groove is immediately adjacent to the one previously wound (winding the grooves consecutively without skipping). Then, the wire portion in grooves not adjacent to one another may be fixed by means of epoxy or solder or other means to one electrical contact and the remaining wire portions fixed similarly to a different electrical contact. Such and other variations are within the scope of the invention.

It will be noted that, after the wire portions between the contacts at the back side 20' of the board 20 have been cut, each wire portion within the groove can be independently adjusted, replaced, repaired or otherwise treated (e.g. chemically or mechanically) independently of any other wire portion in any other groove. This greatly increases the flexibility of manufacture and repair. Thus, where wire set 2 is wound only after wire set 1 has been completed, it is possible to first inspect or correct wire set 1 to ensure that it is correctly wound before winding the wire to form wire set 2. In this manner, it is easier to make adjustments to wire set 1. Furthermore, if it turns out that wire set 1 cannot be repaired prior to the winding of wire set 2, the device can be discarded without further time and effort wasted in forming wire set 2.

Figure 4:
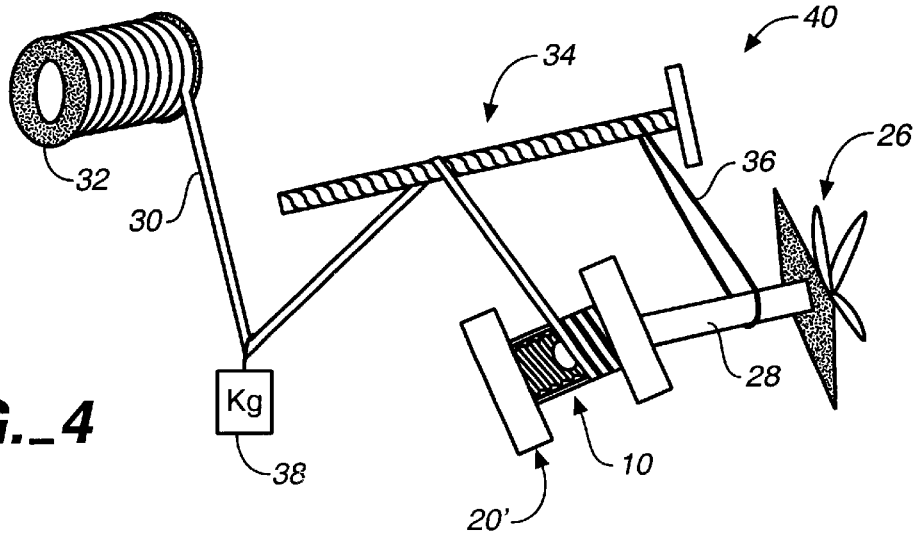
FIG. 4 is a perspective view of an instrument for winding a wire onto the "H"-shaped board and the polymer block to illustrate one embodiment of a process for making a Bradbury-Nielson gate.

By means of the instrument illustrated in FIG. 4 described above, the winding process is much faster than techniques previously used. Thus, in one embodiment, the wire may be wound into the grooves at a speed of not less than 1 winding per minute. Thus, it is possible to wind the wire into more than 100 grooves of the surface in less than about two hours. Where wire set 1 and wire set 2 are wound separately as described above, both sets of wires may be wound into more than 100 grooves of the surface and the printed circuit board pieces 42*a* and 42*b* may be provided, where the total time for forming the two wire sets and for providing contacts 42*a*, 42*b* can be performed in less than about three hours.

During the inspection, repair or replacement of the portions of the wires in the grooves, the grooves may be used for alignment purposes. While in the embodiment described above, the directing screw is turned by means of a timing belt connecting the directing screw to the hand-cranked screw, this is not required, and both screws may be turned independently by hand or by motor, but preferably in synchronism.

To maximize ion transmission at the gate, it may be desirable to employ wires that are thin. If thin wires are used during the winding process, they are more likely to break during the process. Therefore, instead of employing thin wires in the above winding process, thick wires may be used instead. After the wire portions are in place within the grooves, the wires may then be etched to reduce their cross-sectional dimensions and to increase or preferably maximize ion transmission at the gate. The size of the wires may also be changed by processes other than etching, such as plating or other chemical processes. Such and other variations are within the scope of the invention. The grooves in block 10 may also be formed so that the grooves have a desired profile to fit the shape of the wire. For instance, flat-bottomed grooves could be made with widths exactly matching the diameter of the wire, or round-bottomed grooves with shape identical to the wire could be used.

While the invention has been described above by reference to various embodiments, it will be understood that changes and modifications may be made without departing from the scope of the invention, which is to be defined only by the appended claims and their equivalents. All references referred to herein are incorporated by reference in their entireties.

What is claimed is:

1. A method for making a gate for electrically modulating a beam of charged particles, comprising:

providing a body having a surface and grooves on the surface, a hole in the body through the surface, and at least a first and a second electrical contact on the body;

winding an electrically conducting wire under tension onto the grooves so that a first set of portions of the wire in grooves that are not adjacent to one another is in contact with the first electrical contact, and a second set of portions of the wire is in at least some of the remaining grooves and in contact with the second electrical contact, and so that the two sets are electrically isolated from each other; and attaching the first set of portions of the wire to the first electrical contact and the second set of portions of the wire to the second electrical contact so that the portions of the first and second sets of the wire passing over a side of the hole at the surface are fixed in position, wherein the grooves and the surface are such that the two sets of wires are substantially coplanar at the hole.

2. The method of claim 1, wherein the winding comprises winding the wire onto some of the grooves that are not adjacent to one another so that the wire in such grooves is in electrical contact with the first electrical contact, the portions in such grooves forming the first set, and then winding the wire onto at least some of the remaining grooves and so that the wire in such grooves are in contact with the second electrical contact, the portions in such grooves forming the second set.

3. The method of claim 2, further comprising inspecting the first set of portions of the wire after it has been wound, but before winding of wire to form the second set.

4. The method of claim 3, further comprising adjusting the first set of portions of the wire after it has been wound, but before winding of wire to form the second set.

5. The method of claim 2, wherein the providing provides the second electrical contact after the winding of the wire to form the first set and before the winding of the wire to form the second set.

6. The method of claim 5, wherein said winding winds both sets of portions of the wire into more than 100 grooves of the surface and the providing provides the second contact in a combined time period of less than about 3 hours.

7. The method of claim 1, further comprising inspecting, repairing or replacing one or more portions of the wire in the first or second set without affecting the remaining portions of the wire in the first and second sets.

8. The method of claim 1, wherein the inspecting, repairing or replacing comprises aligning said one or more portions of the wire in the first or second set by means of one or more corresponding groove(s) for housing such portion (s).

9. The method of claim 1, wherein the winding employs an instrument that aligns the wire with selected grooves on the surface and causes the wire to be wound onto such grooves.

10. The method of claim 9, wherein the winding comprises:

directing the wire under tension by means of a directing member onto selected grooves on the surface; and causing the body to rotate so that the wire is wound into selected grooves of the body, so that the wire passes over the hole and is in contact with one of the at least first and second electrical contact.

11. The method of claim 10, wherein the directing comprises turning a directing screw and the causing comprises turning a hand-cranked screw connected to the body substantially in synchronism with the turning of the directing screw.

12. The method of claim 11, wherein the turning of the directing screw and the turning of the hand-cranked screw are synchronized by means of a timing belt connecting the directing screw and the hand-cranked screw.

13. The method of claim 10, wherein said winding winds into the grooves at a speed of not less than 1 winding per minute.

14. The method of claim 10, wherein said winding winds into more than 100 grooves of the surface in less than about 2 hours.

15. The method of claim 1, further comprising feeding the wire from a source and suspending a weight on the wire to maintain constant wire tension during winding.

16. The method of claim 1, further comprising removing portions of the wire passing over another side of the hole, so that an array of wire portions is present only on one side of the hole.

17. The method of claim 1, wherein said providing provides the body having a surface and grooves on the surface, wherein said grooves are spaced apart by less than about 0.1 mm.

18. The method of claim 1, wherein said providing provides the body having a surface and grooves on the surface, wherein said grooves have selectable depths and widths.

19. The method of claim 1, wherein said providing comprises determining a profile of the grooves as a function of shape of the wire, and causing the body provided to have grooves on the surface with such profile.

20. The method of claim 1, further comprising chemically treating the portions in the first and/or the second set.

21. The method of claim 1, further comprising etching or plating the portions in the first and/or the second set.

22. The method of claim 1, wherein the attaching attaches some of the portions of the wire prior to completion of the winding of the wire onto grooves to form the first and/or the second set.

23. A gating apparatus for electrically modulating a beam of charged particles, comprising:

a body having a surface and grooves on the surface, a hole in the body through the surface, and at least a first and a second electrical contact on the body;

a first set of electrically conducting wires located in grooves that are not adjacent to one another, said first set being in electrical contact with the first electrical contact; and a second set of electrically conducting wires located in at least some of the remaining grooves on the surface, said second set being in electrical contact with the second electrical contact, the two sets being electrically isolated from each other, wherein the two sets of portions of wires pass over a side of the hole at the surface and the grooves and the surface are such that the two sets of wires are substantially co-planar at the hole.

24. The apparatus of claim 23, wherein the two sets are fixed in position relative to the hole.

25. The apparatus of claim 23, wherein said grooves are spaced apart by less than about 0.1 mm.

26. The apparatus of claim 23, wherein the portions in the first and/or second set have been etched or plated.

27. A method comprising:

winding electrically conducting wire under tension about a body, the body having a surface and a plurality of wire-positioning features along the surface, said features comprising grooves on the surface, the wires wound so that the positioning features comprising grooves maintain a first set of portions of the wire interspersed with a second set of portions of the wire across the surface;

electrically isolating the two sets from each other and attaching the first set of portions of the wire to a first electrical contact and the second set of portions of the wire to a second electrical contact; and modulating a beam of charged particles transiting a hole through the surface of the body using electrical potentials applied to the first and second electrical contacts while the portions of the first and second sets of the wire span the hole and are substantially co-planar at the hole.

28. A gating apparatus for electrically modulating a beam of charged particles, comprising:

a body having a surface and a hole in the body through the surface and grooves on the surface;

a first set of electrically conducting wires in the grooves in electrical contact with a first electrical contact; and a second set of electrically conducting wires in the grooves interspersed with the first set with a spacing between adjacent wires of the two sets being about 0.1 mm or less, said second set being in electrical contact with a second electrical contact, the two sets being electrically isolated from each other, wherein the two sets of portions of wires span the hole along the surface such that the two sets of wires are substantially co-planar at the hole.

* * * * *